US008443481B2

(12) United States Patent
Altun

(10) Patent No.: US 8,443,481 B2
(45) Date of Patent: May 21, 2013

(54) MOP HEAD WITH ATTACHMENT PART

(76) Inventor: Ömer Altun, Vasteras (SE)

( * ) Notice: Subject to any disclaimer, the term of this patent is extended or adjusted under 35 U.S.C. 154(b) by 250 days.

(21) Appl. No.: 12/999,553

(22) PCT Filed: Jun. 22, 2009

(86) PCT No.: PCT/SE2009/050781

§ 371 (c)(1),
(2), (4) Date: Dec. 16, 2010

(87) PCT Pub. No.: WO2009/157862

PCT Pub. Date: Dec. 30, 2009

(65) Prior Publication Data

US 2011/0099740 A1 May 5, 2011

(30) Foreign Application Priority Data

Jun. 26, 2008 (SE) ..... 0801506

(51) Int. Cl.
*A47L 13/255* (2006.01)

(52) U.S. Cl.
USPC ..... 15/228; 15/144.1; 15/144.2; 15/147.1

(58) Field of Classification Search
USPC ..... 15/144.1, 144.2, 145, 147.1, 147.2, 15/228, 229.1, 229.2
See application file for complete search history.

(56) References Cited

U.S. PATENT DOCUMENTS

| | | | | |
|---|---|---|---|---|
| 1,437,789 | A | 12/1922 | Whyte | |
| 1,613,421 | A * | 1/1927 | Warr | 238/330 |
| 3,050,762 | A | 8/1962 | Ballinger | |
| 5,467,496 | A | 11/1995 | Jarvis | |
| 5,502,862 | A * | 4/1996 | Vosbikian | 15/175 |
| 5,839,147 | A * | 11/1998 | Chia-Yi et al. | 15/119.2 |
| 7,237,295 | B2 | 7/2007 | Lindholm | |
| 7,418,758 | B1 * | 9/2008 | Avila | 15/119.2 |

FOREIGN PATENT DOCUMENTS

| | | | |
|---|---|---|---|
| DE | 2731432 | A1 | 1/1979 |
| EP | 0277102 | A2 | 8/1988 |
| SE | 461890 | A | 4/1990 |
| SE | 0201675 | A | 12/2003 |
| SE | 525434 | C2 | 2/2005 |

OTHER PUBLICATIONS

International Search Report, dated Sep. 30, 2009, from corresponding PCT application.
European Search Report, dated Oct. 21, 2011, in EP 09770487.

* cited by examiner

*Primary Examiner* — Monica Carter
*Assistant Examiner* — Michael Jennings
(74) *Attorney, Agent, or Firm* — Young & Thompson

(57) ABSTRACT

A mop head with an attachment part for receiving a handle. The attachment part is arranged to slide along the mop head between at least two fixed positions, in which the attachment part cooperates with the mop head in a locking fashion through the action of locking elements. The attachment part is provided with at least one unlocking element that, when a force directed towards another fixed position is applied on the unlocking element, by acting on the locking element cancels the locking cooperation between the attachment part an the mop head. In particularly advantageous embodiments, the unlocking elements are embodied as ears arranged at the attachment part. Further, the locking elements may include attachment lips arranged on the unlocking elements that cooperate with attachment bores on the mop head. The attachment part may also be arranged to slide in a groove in the mop head with a receiving element.

5 Claims, 2 Drawing Sheets

MOP HEAD WITH ATTACHMENT PART

FIELD OF THE INVENTION

The present invention relates to a mop head with an attachment part.

BACKGROUND OF THE INVENTION

SE461890 discloses a mop with a mop head to which a handle is attached via an attachment part. The attachment part is arranged to slide in a groove in the mop head between different positions and is locked in a chosen position using a locking device. The locking device requires grasping with one hand for unlocking such that the attachment part may be shifted. Coming in direct contact with the mop head is unhygienic and impractical.

An object of the invention is therefore to provide a mop head with an attachment part which facilitates shifting of the attachment part in relation to the mop head.

These and other objects are attained by a mop head with an attachment.

SUMMARY OF THE INVENTION

This invention relates to a mop head 1 with an attachment part 2 for receiving a handle 3. The attachment part 2 is arranged to slide along the mop head between at least two fixed positions, and in these fixed positions the attachment part 2 cooperates with the mop head in a locking fashion through the action of locking elements 5*a-b*, 9*a-b*. The attachment part 2 is provided with at least one unlocking element 8*a, b* that, when a force directed towards another fixed position is applied on the unlocking element 8*a, b*, by acting on the locking element 5*a-b*, 9*a-b* cancels the locking cooperation between the attachment part an the mop head. This has the advantage that if pressure is applied to the unlocking element, i.a. by pushing with a foot, the attachment part is both released from its end position and shifted to the other end position. The obvious advantage is thus that with pressure applied in one direction only, the full operation may be performed. Several manipulations are not necessary and grasping from two opposed directions are not necessary, something that in practice only can be performed using a hand.

In particularly advantageous embodiments of the invention, the unlocking elements 8*a, b* are embodied as ears arranged at the attachment part. Further, the locking elements 5*a-b*, 9*a-b* may comprise attachment lips 9*a, b* arranged on the unlocking elements 8*a, b* that cooperates with attachment bores 5*a, b* on the mop head. Yet further, the attachment part 2 may be arranged to slide in a groove 4 in the mop head with a receiving element 7.

DESCRIPTION OF PREFERRED EMBODIMENTS

Figure 1:
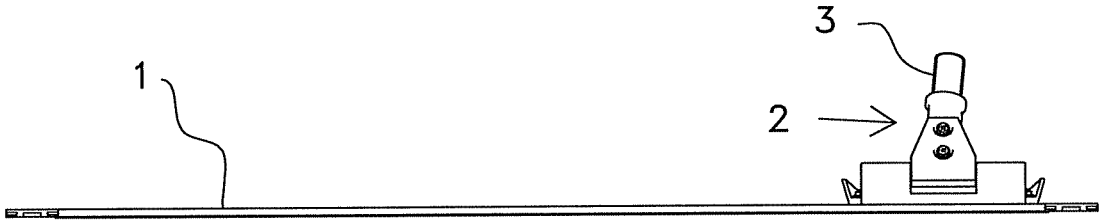
FIG. 1 shows a front view of the mop head with attachment part

FIG. 1 shows a front view of the mop head 1 with an attachment part 2 for a handle 3. Only a short portion of the handle 3 is illustrated in the figure. The mop head 1 is on its lower side arranged to receive a string mop and attach this in an appropriate way. The mop head is essentially rectangular in shape with a longer side, where the attachment part is arranged in a slideable way along the longer side. In the figure, the attachment part is fully shifted towards the end position, which is practical for accessing narrow spaces.

Figure 2:
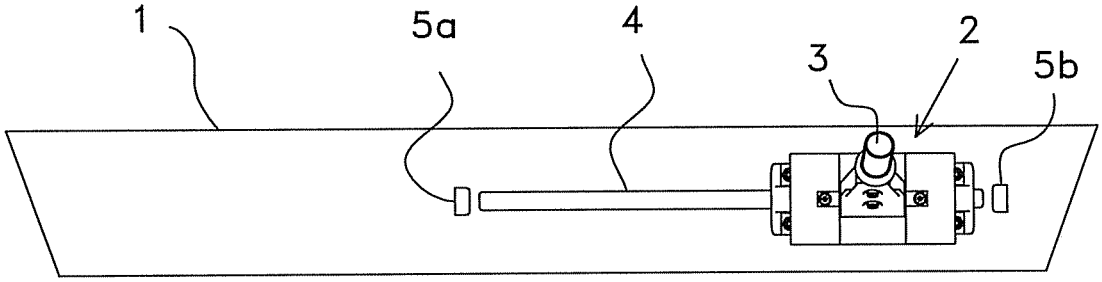
FIG. 2 shows the mop head with attachment part from above

FIG. 2 shows the mop head with the attachment part from above. The figure illustrates that the mop head is provided with a grove 4 that extends approximately from its mid point towards its right shorter end. The attachment part cooperates with the groove and is restricted to slide in the groove between its two ends. In the immediate vicinity of both ends of the groove 4 and the direction of its extension, but separated from the groove, are a mid 5*a* and an outer attachment bore 5*b* arranged. The attachment part 2 has attachment lips at both its shorter ends that may cooperate with and lock the attachment part in place in one of the two end positions. In the figure, the attachment part is shifted to the right in the direction of the shorter side of the mop head, but does not yet read the outer attachment bore an therefore the outer attachment bore 5*b* is clearly illustrated.

Figure 3:
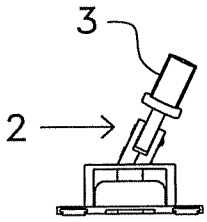
FIG. 3 shows the attachment part for the handle from its short side

FIG. 3 shows the attachment part for the handle from its shorter side and the handle is in the figure angled with respect to the attachment part. As illustrated by FIGS. 1 and 2, the attachment part allows the handle to be angled with respect to the mop head in two directions that are orthogonal to each other, allowing the handle to be angled freely in any direction.

Figure 4:
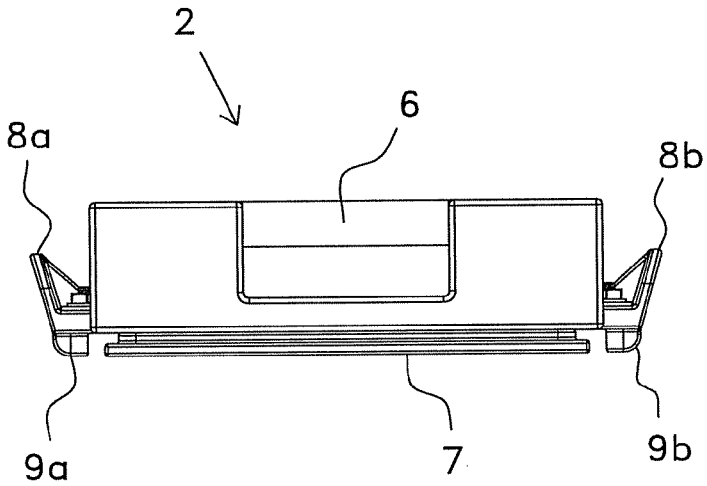
FIG. 4 shows the attachment part for the handle in greater detail facing its longer side

FIG. 4 shows the attachment part for the handle in greater detail facing its longer side. Details on the attachment part has for reception of the handle have been eliminated in FIGS. 4-6 in order to more clearly illustrated the embodiment. The attachment part has a body shaped essentially as a rectangular cuboid arranged to be aligned against the mop head along an essentially rectangular face such that its longer side extends parallel to the longer side of the mop head. In the upper portion, the attachment part is provided with a recess through which a cylindrical pole 6 extends which is arranged to receive details for attachment to the handle. The attachment part is on its lower side further provided with a flat receiving element 7, which is attached to the underside of the attachment part with a groove extending in its lengthwise direction between the receiving element and the underside of the attachment part. The receiving element is intended to extend under the upper surface of the mop head and the grove between the receiving element and the lower side of the attachment part receives the upper surface of the mop head along the groove.

The attachment part is at both its shorter ends provided with attachment ears 8*a, b* which attach to the short sides of the attachment part above the height at which the attachment part extends along the upper surface of the mop head. The attachment ears 8*a, b* extends outwards at an angle upwards and outwards from the shorter sides and are sufficiently resilient to flex somewhat. On the lower edge of the attachment ears, attachment lips 9*a, b* are attached that in unloaded state reaches below the height at which the attachment part extends along the upper surface of the mop head. By loading either one of the attachment ears in the direction of the short side of the attachment part, the ear bends inwards and this forces the attachment lip 9*a, b* upwards. In unloaded state, the attachment lips extends above the groove 4 on the upper surface of the mop head as they are somewhat wider than the width of the groove, but cooperates with respective attachment bore 5*a, b* once the attachment element has been shifted to either end position.

By forcing either attachment ear against the short side of the attachment part, the corresponding attachment lip is forced up and out of the attachment bore and the entire attachment part may then continue to slide in the groove to the opposite end position. If pressure is applied to the attachment ear, i.a. by pushing with a foot, the attachment part is both released from its end position and shifted to the other end position. The obvious advantage is thus that with pressure applied in one direction only, the full operation may be performed. Several manipulations are not necessary and grasping from two opposed directions are not necessary, something that in practice only can be performed using a hand.

Figure 5:
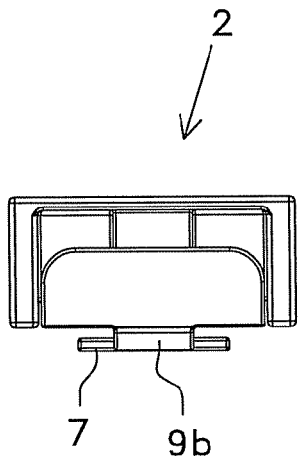
FIG. 5 shows the attachment part for the handle in greater detail from its short side

FIG. 5 shows the attachment part for the handle in greater detail from its short side. That the receiving element 7 extends sideways and how the groove that receives the upper surface of the mop head extends is more clearly illustrated here. One of the attachment ears 8*b* extends from the height on the attachment part that is intended to be aligned against the mop head, and from that one of the attachment lips 9*b* extends.

Figure 6:
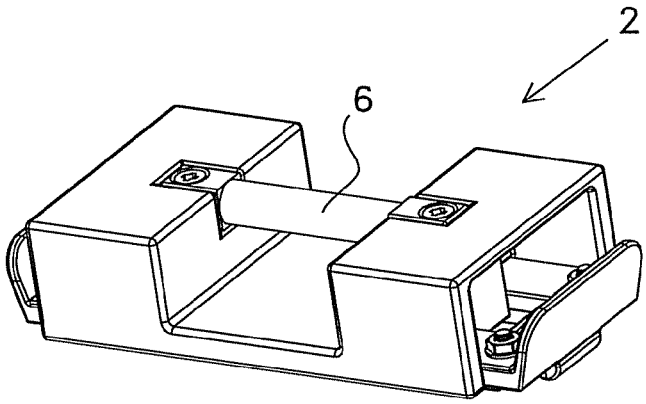
FIG. 6 shows the attachment part for the handle in greater detail from above

FIG. 6 shows the attachment part for the handle in greater detail from above. Here the cylindrical pole 6 that is intended to receive details for attachment to the handle and the attachment screws that hold it in place in both its ends against the remainder of the attachment part are more clearly illustrated. It is clearly illustrated by the figure that the attachment part is constituted by several separate portions that are joined together, but it may obviously be embodied as one solid piece. The illustrated embodiment shows an example of how the attachment part may be designed to attach in one of two snap-in positions and how it may be released from either snap-in position and shifted to the other, but obviously the invention may be embodied in alternative ways.

The invention claimed is:

1. A mop head (1) with an attachment part (2) for receiving a handle (3), where the attachment part (2) is arranged to slide along the mop head between at least two fixed positions, and where in the fixed positions the attachment part (2) cooperates with the mop head in a locking fashion through the action of locking elements (5*a-b*, 9*a-b*), wherein said attachment part (2) is provided with at least one unlocking element (8*a, b*) that, when a force directed towards another fixed position is applied on the unlocking element (8*a, b*), by acting on the locking element (5*a-b*, 9*a-b*) cancels the locking cooperation between the attachment part and the mop head, said locking elements (5*a-b*, 9*a-b*) comprise attachment lips (9*a, b*) arranged on a side of the unlocking elements (8*a, b*) that is intended to face the mop head, and said mop head (1) comprises attachment bores (Sa, b) on a side of the mop head that is intended to face the attachment part.

2. The mop head (1) with an attachment part (2) according to claim 1, wherein at least one unlocking element (8*a, b*) is embodied as an ear arranged at the attachment part.

3. The mop head (1) with an attachment part (2) according to claim 2, wherein said attachment part (2) is arranged to slide in a groove (4) in the mop head with a receiving element (7).

4. The mop head (1) with an attachment part (2) according to claim 1, wherein said attachment part (2) is arranged to slide in a groove (4) in the mop head with a receiving element (7).

5. A mop head (1) with an attachment part (2) according to claim 1, wherein said attachment part (2) is arranged to slide in a groove (4) in the mop head with a receiving element (7).

* * * * *